US005763384A

United States Patent [19]

Ormerod, IV

[11] Patent Number: 5,763,384

[45] Date of Patent: Jun. 9, 1998

[54] SCOURING COMPOSITIONS SAFE FOR SURFACES

[75] Inventor: Raleigh Clair Ormerod, IV, Middletown, Ohio

[73] Assignee: The Procter & Gamble Company, Cincinnati, Ohio

[21] Appl. No.: 662,401

[22] Filed: Jun. 12, 1996

Related U.S. Application Data

[63] Continuation-in-part of Ser. No. 425,512, Apr. 20, 1995, abandoned.

[51] Int. Cl.[6] ..... C11D 1/12; C11D 3/10; C11D 3/395; C11D 7/12

[52] U.S. Cl. ..... 510/380; 510/379; 510/381; 510/445; 510/446; 510/447; 510/531

[58] Field of Search ..... 510/379, 380, 510/381, 445, 446, 447, 531

[56] References Cited

U.S. PATENT DOCUMENTS

| | | | |
|---|---|---|---|
| 3,970,594 | 7/1976 | Claybaugh | 252/524 |
| 3,979,339 | 9/1976 | Claybaugh | 252/524 |
| 5,089,162 | 2/1992 | Rapisarda et al. | 252/102 |
| 5,229,027 | 7/1993 | Ahmed | 252/99 |
| 5,234,615 | 8/1993 | Gladfelter et al. | 252/90 |
| 5,536,437 | 7/1996 | Motyka | 510/397 |
| 5,552,556 | 9/1996 | Miracle et al. | 548/334.1 |

*Primary Examiner*—Paul Lieberman
*Assistant Examiner*—Gregory R. Delcotto
*Attorney, Agent, or Firm*—Robert B. Aylor

[57] ABSTRACT

Hard-surface scouring cleansers contain surfactant; water soluble abrasive/alkalinity mixture of water soluble carbonate and bicarbonate and optional sulfate salts; preferably bleach; optional buffer and/or minors. Such compositions combine the stain and soil removal properties of a strong active chlorine bleaching agent and bleach-stable surfactant in a abrasive cleanser having desirable surface safety and superior rinsing properties.

16 Claims, No Drawings

SCOURING COMPOSITIONS SAFE FOR SURFACES

BACKGROUND OF THE INVENTION

FIELD OF THE INVENTION

This is a continuation-in-part of my U.S. patent application Ser. No. 08/425,512, filed Apr. 20, 1995 now abandoned.

The instant invention relates to solid, preferably bleach-containing, abrasive scouring cleansers. There has been an increasing demand for scouring detergent compositions adapted for cleaning hard surfaces safely. These compositions, when intended for the retail consumer market, should maintain their bleaching effectiveness during ordinary periods of storage and use. An extremely difficult problem in providing effective hard surface cleaning detergent compositions for a variety of tasks. Some agents designed to aid in abrasive cleaning also tend to deposit on the hard surfaces being cleaned, thereby leaving an unsightly film or haze. Thus, there is a continuing need for hard surface scouring products which are chemically and physically stable, which are capable of safely cleaning a variety of surfaces and effectively cleaning a variety of soils.

It has been surprisingly discovered that by combining particular water soluble inorganic salts, effective cleaning of a variety of soils can be achieved with good surface safety.

SUMMARY OF THE INVENTION

The instant hard surface scouring cleanser compositions comprise:

A. from about 0.5% to about 5%, preferably from about 1% to about 4%, and more preferably from about 1.5% to about 3.5%, of bleach stable detergent surfactant, preferably anionic detergent surfactant as described hereinafter;

B. from about 10% to about 99%, preferably from about 50% to about 99%, and more preferably from about 90% to about 99%, of abrasive/alkalinity material that is a mixture of water soluble carbonate and bicarbonate or, optionally mixtures of bicarbonate and sulfate salts, preferably alkali metal salts, more preferably sodium, salts, the ratio of carbonate to bicarbonate, or bicarbonate and sulfate, being from about 0.1:1 to about 10:1, preferably from about 0.1:1 to about 1:1, and more preferably from about 0.1:1 to about 0.80:1;

C. from 0% to about 4%, preferably from about 0.5% to about 3%, and more preferably from about 0.7% to about 1.5% by weight of bleaching agent, preferably hypochlorite bleaching agent; and D. from 0% to about 10% by weight of buffering agent, water, and/or minor ingredients.

The bleach-stable surfactant is preferably a mixture of either a water-soluble paraffin sulfonate detergent surfactant, or alkyl benzene sulfonate detergent surfactant, with alkyl sulfate salt detergent surfactant, said detergent surfactants containing from about 8 to 18 carbon atoms in the alkyl group.

The abrasive material comprises water soluble bicarbonate having a particle diameter in which from about 50% to about 100%, preferably from about 80% to about 100%, more preferably from about 95% to about 100% of the particles are within the range from about 20 to about 100, preferably from about 30 to about 90, microns.

The bleaching agent can be any active chlorine bleaching compound which yields a hypochlorite species in aqueous solution.

DETAILED DESCRIPTION OF THE INVENTION

The scouring cleanser compositions of the instant invention contain detergent surfactant, preferably bleach stable detergent surfactant; the specific carbonate/bicarbonate abrasive/alkalinity source; preferably hypochlorite bleach; and optional additional buffering agent and/or minors. Each of these composition components and composition preparation are discussed in detail hereinafter.

A. BLEACH-STABLE SURFACTANT

From about 0.5% to about 5% by weight, preferably from about 1% to 4%, more preferably from about 1.5% to about 3.5%, by weight, of the instant compositions comprises a preferably bleach-stable surfactant compound. Such surfactants are necessary in scouring cleansers such as those of the instant invention in order to render such compositions effective for removal of soil and stains from hard surfaces. The surfactant selected for use in the present compositions should be stable against chemical decomposition and oxidation by the strong active chlorine bleaching agent also preferably present. Accordingly, surfactant materials of the instant invention preferably contain no functionalities (such as ether linkages, unsaturation, some aromatic structures, or hydroxyl groups) which are susceptible to oxidation by the hypochlorite species preferably found in the present compositions.

Thus many of the commonly employed surfactant materials of the prior art, e.g., olefin sulfonates, alkyl glyceryl ether sulfonates, alkyl ether sulfates and ethoxylated nonionic surfactants are preferably avoided in the compositions of the instant invention.

Bleach-stable surfactants which are especially resistant to hypochlorite oxidation fall into two main groups. One such class of bleach-stable surfactants are the water-soluble alkyl sulfates containing from about 8 to 18 carbon atoms, preferably from about 8 to about 16 carbon atoms in the alkyl group. Alkyl sulfates are the water-soluble salts of sulfated fatty alcohols. They are produced from natural or synthetic fatty alcohols containing from about 8 to 18 carbon atoms, preferably from about 8 to about 16 carbon atoms. Natural fatty alcohols include those produced by reducing the glycerides of naturally occurring fats and oils. Fatty alcohols can also be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, potassium coconut alkyl sulfate and mixtures of these surfactants. Highly preferred alkyl sulfates are sodium coconut alkyl sulfate, potassium coconut alkyl sulfate, potassium lauryl alkyl sulfate and sodium lauryl alkyl sulfate.

A second class of bleach-stable surfactant materials operable in the instant invention are the water-soluble sulfonate surfactants. These materials have the general formula: $R\text{-}SO_3M$ wherein R is an alkyl or alkyl benzene group containing from about 8 to about 18, preferably from about 10 to about 16 carbon atoms in the alkyl.

Examples of suitable sulfonate compounds of this type include: sodium $C_{10-16}$ alkyl benzene sulfonate and sodium $C_{10-16}$ paraffin sulfonate.

The ratio of sulfate to sulfonate detergent surfactant is from about 0.15:1 to about 10:1, preferably from about 0.15:1 to about 5:1, more preferably from about 0.25:1 to about 1:1.

Other bleach stable detergent surfactants include mono-long chain amine oxide detergent surfactant having one long alkyl chain containing from about 8 to about 18 carbon atoms, preferably from about 10 to about 16 carbon atoms, and more preferably from about 10 to about 14 carbon atoms. The other two groups are short chain, preferably containing from 1 to about 4 carbon atoms, more preferably methyl groups.

The primary limitation is that the surfactant not react with any bleaching agent present. This is not a concern if the surfactant is protected, or if the bleaching agent is protected, not present, or is not very reactive.

B. CARBONATE/BICARBONATE/OPTIONAL SULFATE ABRASIVE/ALKALINITY MATERIAL

The compositions contain from about 10% to about 99%, preferably from about 50% to about 99%, and more preferably from about 90% to about 99%, of a mixture of water soluble carbonate and bicarbonate salts or mixtures of bicarbonate and sulfate salts, preferably alkali metal salts, more preferably sodium, salts, the ratio of carbonate to bicarbonate and optional sulfate being from about 0.1:1 to about 10:1, preferably from about 0.1:1 to about 1:1, and more preferably from about 0.1:1 to about 0.80:1. The abrasive material comprises water soluble bicarbonate having a particle diameter in which from about 50% to about 100%, preferably from about 80% to about 100%, more preferably from about 95% to about 100% of the particles are within the range from about 20 to about 100, preferably from about 30 to about 90, microns. The abrasive material also comprises water soluble carbonate salts. The particle size for this material can be one in which from about 50% to about 100%, preferably from about 75% to about 95%, more preferably from about 80% to about 95% of the particles are within the range from about 20 to about 100, preferably from about 20 to about 75, more preferably from about 20 to about 60 microns.

The ratios and/or amounts of the carbonate and bicarbonate and optional sulfate are essential to providing a combination of surface safety and effective cleaning on a variety of soils. The level of carbonate has to be at least about 10%, preferably at least about 15%, and more preferably at least about 25%, in order to provide the desired level of cleaning on greasy soap scum soil. Similarly, the level of carbonate cannot be more than about 70%, preferably not more than about 50%, and more preferably not more than about 40%, in order to have the desired low level of reserve alkalinity above about 9.5 pH.

Surprisingly, the correct particle size of bicarbonate is essential to having good surface safety. If the particle size is more than about 100 microns, the surface safety is harmed. On the other hand, if one uses the typical size of bicarbonate that is sold, having a particle size of about 25 microns, the cleaning effectiveness is compromised unless the carbonate is used to compensate. As used herein, all particles sizes are bulk weight % averages (95% by weight of the material has a diameter less than the indicated diameter) unless otherwise noted. The particle size of the carbonate is not as critical, since the normal particle size of about 50 microns is satisfactory. Similarly, the normal size of sulfate, e.g., sodium sulfate salts, is also suitable. The level of bicarbonate has to be at least about 5% preferably at least about 20%, and more preferably at least about 25% of the combined bicarbonate and sulfate salts.

The sodium salts of the bicarbonate, sulfate and carbonate are preferred, but other salts such as potassium and/or lithium salts can be used.

C. BLEACHING AGENT

From 0% to about 4% by weight, preferably from about 0.5% to 3%, and more preferably from about 0.7% to about 1.5%, by weight, of the instant compositions comprises a bleaching agent, preferably of the type which yields a hypochlorite species in aqueous solution. The hypochlorite ion is chemically represented by the formula $OCl^-$. The hypochlorite ion is a strong oxidizing agent and for this reason materials which yield this species are considered to be powerful bleaching agents. The strength of an aqueous solution containing hypochlorite ion is measured in terms of available chlorine. This is the oxidizing power of the solution measured by the ability of the solution to liberate iodine from an acidified iodide solution. One hypochlorite ion has the oxidizing power of two atoms of chlorine, i.e., one molecule of chlorine gas.

At lower pH levels, aqueous solutions formed by dissolving hypochlorite-yielding compounds contain active chlorine partially in the form of hypochlorous acid moieties and partially in the form of hypochlorite ions. At pH levels above about 10, i.e., at pH levels of the instant compositions, essentially all of the active chlorine is in the form of hypochlorite ion.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate, 1,3-dichloro-5,5-dimethylhydantoin, N-chlorosulfamide, Chloramine T, Dichloramine T, Chloramine B and Dichloramine B. A preferred bleaching agent for use in the compositions of the instant invention is sodium dichlorocyanurate.

Most of the above described hypochlorite-yielding bleaching agents are available in solid or concentrated form and are dissolved in water during synthesis of the compositions of the instant invention. Some of the above materials are available as aqueous solutions.

Other bleaching agents can be used if cost and/or effectiveness can be compromised. E.g., it is possible to use activated peroxide as a bleaching material.

D. OPTIONAL ADDITIONAL BUFFERING AGENT AND MINORS

1. ADDITIONAL BUFFERING AGENT

From 0% to about 10%, preferably from 0% to 5%, and more preferably from 0% to about 3%, by weight of additional buffering agent can be used. The present compositions can comprise additional inorganic buffering agent capable of maintaining composition pH within the range of from about 8.5 to 11; preferably from about 9 to 9.5. Maintenance of composition pH within this range serves to enhance composition performance.

Any bleach-stable material or mixture of materials which has the effect of altering composition pH to within the desired range and maintaining it there can be utilized as the additional buffering agent in the instant invention. Such materials can include, for example, various water-soluble, inorganic salts such as the sequiscarbonates; silicates, pyrophosphates, phosphates, tetraborates, and mixtures thereof. Examples of materials which can be used either alone or in combination as the buffering agent herein include sodium sesquicarbonate, sodium silicate, tetrapotassium pyrophosphate, trisodium phosphate, anhydrous sodium tetraborate, sodium tetraborate pentahydrate and sodium tetraborate decahydrate. Preferred buffering agents for use herein are non-phosphates.

As will be discussed hereinafter, it is highly preferred to include in the instant compositions a material which acts as a detergent builder, i.e. a material which reduces the free calcium and/or magnesium ion concentration in a surfactant-containing aqueous solution. Some of the above-described materials of the additional buffering agent component additionally serve as builder materials. Such compounds as the phosphates, especially the condensed phosphates like pyrophosphates and tripolyphosphates, and the polycarboxylates, like citrates, succinates, etc., are of this type. Other buffering agent components such as the silicates and tetraborates perform no building function. Since presence of a builder in the instant compositions is highly desirable, it is preferred that the additional buffering agent contain at least one compound capable of acting as a builder, i.e. capable of lowering the free calcium and/or magnesium ion content of an aqueous solution containing such ions.

2. OPTIONAL MATERIALS

In addition to the above-described components, the instant scouring compositions can optionally contain other non-essential materials to enhance their performance, stability, or aesthetic appeal. Such materials include optional suds suppressants, non-buffering builder compounds, coloring agents and perfumes. Suds suppressors are especially useful for improving ease of rinsing and end result grit. Fatty acids, silicates, and highly branched polymers, including even finely divided plastic materials, can be used as suds suppressors.

Although, as noted above, some of the above described buffering agents do function as builder compounds, it is possible to add other bleach-stable builder compounds which either alone or in combination with other salts do not buffer within the desired pH range required of the buffering agent. Typical of these optional builder compounds which do not necessarily buffer within the essential pH range are certain hexametaphosphates and polyphosphates. Specific examples of such optional buffer materials include sodium tripolyphosphate, potassium tripolyphosphate and potassium hexametaphosphate. Conventional coloring agents and perfumes can also be added to the instant compositions to enhance their aesthetic appeal and/or consumer acceptability. These materials should, of course, be those dye and perfume varieties which are especially stable against degradation by strong active chlorine bleaching agents. If present, the above-described optional materials generally comprise no more than about 5% by weight of the total composition.

COMPOSITION PREPARATION

The scouring compositions of the instant invention can be prepared by admixing the above-described essential and optional components together in the appropriate concentrations in any order by any conventional means normally used to form particulate mixtures.

However, it is also desirable to admix the compositions using particles formed as part of a pre-mixing step. It is especially desirable to pre-form the surfactant into particles with inorganic salts.

The invention also comprises the process of cleaning a hard surface comprising applying an effective amount of the composition disclosed herein to said hard surface with an effective amount of water and scrubbing said surface with a cleaning implement. Suitable cleaning implements are those known in the art such as cloths, sponges, non-wovens, paper towels, etc.

The cleanser compositions of the instant invention are illustrated by the following examples. All parts, ratios, percentages, etc. herein are by weight and all numerical limits are approximations within the normal limits of analytical determination unless otherwise stated.

EXAMPLE I

A detergent premix of the following composition is prepared.

| | Target (Parts) |
|---|---|
| Na Linear alkyl ($C_{10-14}$) benzene sulfonate (Na LAS) | 1.30 |
| Soda Ash | 25.00 |
| Na Acetate | 1.52 |
| Na $C_{8-16}$ alkyl sulfate (NaAs) | 0.86 |
| Water | 0.22 |
| Other minors | 0.10 |
| Premix Total Parts | 29.00 |

Such a premix is prepared as follows in a reaction screw mixer with the following order of addition.

| Raw Material Added) | Parts |
|---|---|
| Soda Ash | 26.20 |
| HLAS/Acetic acid | 2.38 |
| NaAs | 0.91 |

There is a loss of about 0.49 parts $CO_2$ and the mixture is at about 0.76% moisture.

A hard surface scouring cleanser of the following composition is prepared in a main mix screw mixer

| Order of Addition | Composition Parts |
|---|---|
| Sodium Bicarbonate | 69.64 |
| Detergent Premix | 29.00 |
| Sodium Dichlorocyanurate (NaDCC) | 1.01 |
| Moisture (NaDCC) | 0.15 |
| Perfume | 0.20 |
| Finished Product Parts | 100.00 |

Such a composition exhibits negligible bleach and/or surfactant decomposition over a storage period of 6 weeks. Such a composition is especially effective for removal of stains and soil from hard surfaces and leaves no noticeable film after the composition has been used and the hard surfaces rinsed.

Compositions of substantially similar physical, chemical and performance properties are realized when in the Example I composition, the sodium dichloroisocyanurate bleaching agent is replaced with 1,3-dichloro-5,5-dimethylhydantoin, N-chlorosulfamide, Chloramine T, Dichloramine T, Chloramine B or Dichloramine B in amounts sufficient to provide an equivalent amount of available chlorine.

EXAMPLE II

Composition Prepared by Dry Mixing

| Order of Addition | Parts | Target Composition |
|---|---|---|
| Sodium bicarbonate | 69.76 | 69.76 |
| Soda Ash | 25.00 | 25.00 |
| NaLAS | 1.45 | 1.30 |
| Na As | 0.91 | 0.86 |
| Na Acetate | 1.52 | 1.52 |
| Moisture (Det) | | 0.20 |
| NaDCC | 1.16 | 1.01 |
| Perfume | 0.20 | 0.20 |
| Moisture (NaDCC) | 0.00 | 0.15 |
| Finished Product | 100.00 | 100.00 |

Performance of these products are evaluated using the following tests.

SOIL REMOVAL PERFORMANCE

Soil removal performance is measured by two tests.

GREASY SOAP SCUM TEST

The greasy soap scum test is representative of soap scum/body soil found in bathrooms. The necessary equipment/materials are as follows; 1. 4 Cherokee Porcelain Panels ( 3"×15"); 2. Household Blender; 3. 1 Preval Sprayer; 4. Oven; 5. Vented Fume Hood; 6. Straight Line Washability Machine; and 7. Flocel Cellulose Sponges cut to 3 ¾"×1 ⅞" when wet. The soil is a mixture of carbon lamp black, calcium stearate; and artificial body soil (ABS).

Pre-clean panel with isopropyl alcohol prior to soiling and buff dry with a paper towel. Preheat oven to 180 degrees C. In the fume hood, spray each panel with a soil solution using a back and forth uniform motion. Each "pass" represents one complete soil application. After 8 passes, rotate the plate 180 degrees. Spray the plate 8 more passes for a total of 16 sprays.

Place the soiled panels horizontally onto a single oven rack positioned as close to the center of the oven as possible and bake for 20 minutes. Start the timer after placing the panels in the preheated oven. After bake time is completed, remove the panels from the oven and let cool. When the panels are cool they may be performance tested.

Place the soiled plate into the scrub machine. Sponges are wet with 80 degree F. city water and wrung out completely. Sponges of approximately equal weight and feel are chosen for testing. After choosing your sponges, they are left in a 2000 ml. beaker of 80 degree F. city water until ready to use. The stroke setting product (control product) is always the first product tested. Center the sponge carrier over the area on the plate to be tested. Place 2 gms. product directly to the area and apply 1 ml. water to make a paste to cover entire sponge area. Allow to soak for 10 seconds. Place damp (18–22 gm) sponge into holder (1300 gm) , place in carrier and start scrub machine.

Clean control to 80% clean. Use this number of strokes for all products in the test for that particular plate. Stroke # must be determined separately for each plate. The area tested is rinsed immediately with 80 degree F. water, with care taken not to get the untested portion of the panel wet. Pat dry with a paper towel.

Use an Absolute Score scale (0–6) and have 3 expert judges, grade three replications of each treatment. Enter grades through a standard computer program to determine significance.

TOUGH GREASY KITCHEN DIRT (Naturally Aged Kitchen Dirt or "KD" soil)

The necessary equipment/materials are: 1. 4 Cherokee Porcelain Plates (3"×15"); 2. Household Blender; 3. KD Soil; 5. Aluminum foil; 6. Straight Line Washability Machine; and 7. Flocel Cellulose Sponges cut to 3 ¾"×1 ⅞" in. (when wet). KD Soil comprises Crisco Oil and particulate/grease soil w/Carbon Black.

Pre-clean each clean panel with Isopropyl Alcohol prior to soiling and buff dry with a paper towel. Measure 1.25 gms. of KD soil onto a piece of aluminum foil, and spread the soil out on the foil so that it is evenly dispersed. If roller has never been used, you must evenly saturate the roller with about 1 teaspoon of the soil. Evenly coat the paint roller with soil by rolling it in the dispersed KD soil. Roll the soil onto the panels until an even coating of soil is achieved on each panel. Place the soiled panels on a flat surface, ambient temperature, 40–50% humidity and allow to age for 6 to 10 days.

Place the soiled plate into the scrub machine. Sponges are wet with 80 degree F. city water and wrung out completely. Sponges of approximately equal weight and feel are chosen for testing. After choosing your sponges, they are left in a 2000 ml. beaker of 80 degree F. city water until ready to use. The stroke setting product (control product) is always the first product tested. Choose a sponge and squeeze until it is just damp. Place the sponge on the balance and weigh 2 gms./2 mls product onto the sponge. Syringe 2 mls. water onto product to make a paste if using powders. Spread the product evenly onto the middle third of the sponge. Place the sponge into the sponge holder which weighs approximately 300 gms., place into the carriage, and start the machine. The number of strokes used for a given test is determined by cleaning with the stroke setter product until the surface is roughly 80% clean. The remaining products in that test are then used with the same number of strokes. The number of strokes required for a given test can vary depending on the set of products used, soil toughness, etc. The area tested is rinsed immediately after being scrubbed, with care taken not to get the untested portion of the panel wet. Pat dry with a paper towel. Grading Procedure Use an Absolute Score scale (0–6) and have 3 expert judges grade three replications of each treatment. Enter grades through the standard Absolute Production Capsule computer program to determine significance.

SURFACE SAFETY EVALUATION

This test is used to determine relative safety to surfaces of test products over an extended use period. The equipment is: 1. Gardner Straight Line Washability Machine; 2. Test Panels and 3. Sponge. Test panels are cut into pieces 3" by 16" and inserted into the Gardner machine. This machine is designed to simulate the scrubbing action applied to surfaces during cleaning. The apparatus consists of a base panel for holding the panels to be scrubbed, a carriage which travels back and forth across the panel, and a sponge holder which is weighted to apply constant pressure. A pre-determined amount of water and product is applied to the sponge and spread evenly over the middle ⅓ of a sponge. The sponge is then placed in the sponge holder and into the carriage. The machine's automatic counter is then set for the pre-determined number of strokes (50). After 50 strokes, the sponge is rinsed and water and product are applied to the other side of the sponge for another 50-stroke treatment then discarded. The panel is rinsed every 100 strokes. A carriage which exerts 7 gms/cm$^2$ pressure is used. The product usage is 2 grams onto a sponge which weighs 35 gms. (sponge+water). When the panels are untreated, they are only rinsed and for determining the effect of water, the sponge is dampened with water only.

For grading, the test panels are graded visually using a standard 0–4 grading scale. The treatments are randomized on the panels according to the randomization chart: 0=Equal; 1=I think this one is damaged/discolored; 2=I know this one is damaged/discolored; 3=I know this one has a lot of damage/discoloration; and 4=I know this one has a whole lot of damage/discoloration. Visual grading and gloss readings are taken initially and after 200, 400, 800, 1200 and 1600 strokes. Visual grading uses a SAS statistical program which accepts absolute grades and calculates a mean and a least significant difference.

END RESULT GRIT

This rinsing method simulates consumer end result from rinsing with abrasive cleansers. One key factor in rinsing powder cleaners is the residual grit/film left by these products. Therefore, this test method focuses on the gritty residue left behind after rinsing the product from black ceramic tile with water.

The necessary equipment/materials are; 1. 4"×4" black ceramic tiles (black tiles are used to better see residual product differences); 2. FLOCEL Cellulose Sponges cut to 2×2×⅞ in. (when wet); 3. 2000 ml. beaker; and 4. Balance.

Pre-clean each tile with Isopropyl Alcohol prior to using and buff dry with a paper towel. Sponges are wet with 118 degree F. city water and wrung out completely. Sponges of approximately equal weight and feel are chosen for testing. The sponges are placed in a 2000 ml. beaker of 118 degree F. city water until ready to use. Choose a sponge, wring out excess water, place on balance and add 2 gms. product and 2 mls. water. Make a paste of product and spread over entire surface. Apply product with sponge onto surface with even pressure, 4 strokes across and 4 strokes down. Incline tile at 30 degrees. Rinse tile with varying amounts (10–20–40 mls.) of 118 degree F. city water. Direct water with a syringe across top of the tile to better control the water quantity and the direction over the entire surface. Various amounts of water are used to simulate different degrees of rinsing by consumers, e.g., water quantity/pressure and percent of area rinsed. The limits are set to approximate a minimum of one rinse over surface and a maximum equal to the amount of rinsing needed to completely clean the tile with the better rinsing product. Allow tiles to air dry or use blow dryer gently.

The test panels are graded visually using a standard 0–6 grading scale. The treatments are randomized on the plates according to the randomization chart in which: 0=No grit/film; 1=I think this one has some grit/film 2=I know this one has some grit/film; 3=I know this one has a lot of grit/film; 4=I know this one has a whole lot of grit/film; 5=I know this one has a whole lot more grit/film; and 6=I know this one has not cleaned at all. Enter visual grades through a SAS statistical program which accepts absolute grades and calculate a mean to determine significances.

The following examples demonstrate the criticality of the limits herein.

Sodium Bicarbonate Grade and Particle Size Effects Surface Safety

Surface safety is primarily affected by (1) hardness of the abrasive, and (2) particle size of the abrasive. When the bulk (95%) of the sodium bicarbonate abrasive material in the composition (e.g., Example II) has a particle size larger than 45 microns bulk weight %, slight abrasion damage to soft surfaces becomes possible. With larger bicarbonate particles (140 micron bulk weight %), the surface safety advantage relative to powdered calcium carbonate is completely lost.

| Type of Abrasive: | Powdered Calcium Bicarbonate | Fine Granular Sodium Bicarbonate | Coarse Granular Sodium Bicarbonate | Extra Coarse Sodium Bicarbonate |
|---|---|---|---|---|
| Particle Size (bulk weight %): | 20 microns | 45 microns | 90 microns | 140 microns |
| Max. Particle Size | 150 microns | 180 microns | 300 microns | 400 microns |
| Surface Safety (Clear Acrylic): | 2.5 significant damage | 0.0s no damage | 0.3s slight damage | 2.2 significant damage |

Sodium Bicarbonate Grade and Particle Size Effects Bleach Stability and Soil Removal Bleach Stability Bleach stability is importance for maintaining performance on bleachable stains and burned-on foods. Only sodium bicarbonate with the bulk (95%) of material at about 45 microns or below allows the composition of Example II to maintain the bleach stability profile of A as shown in Formula C and Formula D. The coarse granular bicarbonate (90 microns) in Formula B falls short of the A stability benchmark, as shown below in the example formulas.

Soil Removal

Formulas B through D show how larger bicarbonate particle size improves both Soap Scum and Greasy Dirt removal.) Comparing Formula C with Formula A demonstrates that bicarbonate material with the bulk of particles 45 microns or smaller loses the Soap Scum parity with A. Formula D demonstrates that sodium bicarbonate material with the bulk of particles 20 microns or smaller loses the Greasy Dirt superiority vs. A.

Improving Soap Scum Performance By Raising Level of Sodium Carbonate

Increasing the sodium carbonate level recovers the soap scum performance of the fine grade bicarbonate formula. Formula E demonstrates significant soap scum removal deficiency vs. Formula A. Formula F demonstrates that raising the level of sodium carbonate to 15% improves the greasy soap scum performance to a non-significant difference from Formula A. Sodium carbonate inhibits the solubilization rate of sodium bicarbonate because it dissolves faster and increases the solution's ionic strength. This slowing down of dissolution allows the sodium bicarbonate particle to provide more mechanical cleaning. Formula G indicates that this level of soap scum performance is maintained up to 40% sodium carbonate. The A level of soap scum performance is maintained from 15% sodium carbonate to 40% sodium carbonate.

Formulas E–F are formulas in which the surfactant (Na LAS and Na AS) have been lowered to maintain a rinsing end result shine advantage vs. A.

| Formula | A | B | C | D | E | F | G |
|---|---|---|---|---|---|---|---|
| Grade of Bicarbonate: | Powder $Ca\ CO_3$ | Coarse Granule | Fine Granule | Fine Powder | Fine Granule | Fine Granule | Fine Granule |
| Particle Size of Bicarbonate: | 20 Wt. % | 90 microns Wt. % | 45 microns Wt. % | 20 microns Wt. % | 45 microns Wt. % | 45 microns Wt. % | 45 microns Wt. % |
| $Ca\ CO_3$ | 85.00 | | | | | | |
| $Na\ HCO_3$ | — | 82.75 | 82.75 | 82.75 | 85.58 | 79.78 | 54.78 |
| $Na\ CO_3$ | 9.20 | 9.20 | 9.20 | 9.20 | 9.20 | 15.00 | 40.00 |
| Na LAS[1] | 1.45 | 2.00 | 2.00 | 2.00 | 1.30 | 1.30 | 1.30 |
| Na AS[2] | 0.91 | 1.27 | 1.27 | 1.27 | 0.86 | 0.86 | 0.86 |
| Na Acetate | 1.50 | 2.13 | 2.13 | 2.13 | 1.50 | 1.50 | 1.50 |
| Na DCC[3] | 1.00 | 1.01 | 1.01 | 1.01 | 1.02 | 1.02 | 1.02 |
| Perfume: | 0.20 | 0.95 | 0.95 | 0.95 | 0.20 | 0.20 | 0.20 |
| Performance Criteria | | | | | | | |
| 30 Day 120 F. Bleach Stability | 89% | 70% | 90% | 100% | — | — | — |
| Soap Scum vs. A* | Basis | +0.5 | +1.5s | +2.2s | +1.6s | +0.25 | +0.75 |
| Greasy Dirt vs. A* | Basis | −3.0s | −2.5s | +0.6 | — | — | — |

*The performance data is presented relative to A. Positive numbers mean more soil is left behind, therefore worse performance. Negative numbers mean less soil is left behind, therefore better performance. Statistical significance from the A benchmark is indicated by 's'.
[1]Sodium $C_9$ alkyl benzene sulfonate
[2]Sodium $C_{10-16}$ alkyl sulfate
[3]Sodium dichlorocyanurate Surfactant System-Powdered End result grit/film is the appearance of a (black ceramic tile) surface after the product is rinsed away and allowed to dry. It is a measure of rinsability of the product and is influenced by the grittiness and solubility of the abrasive component and the amount of suds or surfactant which is left behind after rinsing. Formula J shows that if the alkyl sulfate level is raised above about 0.86% at the desired 25% Na Carbonate level, the end result grit/film advantage of the Comet BK product disappears. Comparison of Formula K and L further illustrate a significant 0.9 decrease in performance with a modest increase in Na AS (sulfate).

However, while there is a narrow range of sulfate which shows the end result grit/rinsing advantage, the advantage is maintained over a larger range of sulphonate as illustrated by the 0.4 insignificant change comparing Formula M to Formula K, which has an increased level of Na LAS (sulphonate).

| Formula | H Wt. % | I Wt. % | J Wt. % | K Wt. % | L Wt. % | M Wt. % |
|---|---|---|---|---|---|---|
| $Ca\ CO_3$ (insoluble): | 85.00 | — | — | | | |
| $Na\ CO_3$: | 9.20 | 25.00 | 25.00 | 9.20 | 9.20 | 9.20 |
| $Na\ HCO_3$ (45 micron): | — | 69.78 | 69.42 | 85.58 | 85.22 | 85.22 |
| Na LAS[1] | 1.45 | 1.30 | 1.30 | 1.45 | 1.45 | 2.00 |
| Na AS[2] | 0.91 | 0.86 | 1.20 | 0.91 | 1.27 | 0.91 |
| Na Acetate: | 1.50 | 1.50 | 1.50 | 1.50 | 1.50 | 1.50 |
| Na DCC[3] | 1.00 | 1.02 | 1.02 | 1.02 | 1.02 | 1.02 |
| Perfume: | 0.20 | 0.20 | 0.20 | 0.20 | 0.20 | 0.20 |
| End Result Grit/Film Performance: | Basis | −1.00s significant (better) | −0.30 (no significant difference) | −2.4s significant (better) | 1.5s significant (better) | −1.9s significant (better) |

*The performance data is presented relative to A. Positive numbers mean more material is left behind, therefore worse performance. Negative numbers mean less material is left behind, therefore better performance. Statistical significance from the A benchmark is indicated by 's'.

Other Soluble Salts-Sodium Sulfate

Substitution of sodium sulfate for most of the sodium $HCO_3$ in the 70/25/0 (bicarb/carb/sulfate) maintains the soil removal and end result grit/film performance. Formula Q, the 20/25/50 formula, demonstrates all the performance of the 70/25/0 and 44/40/0 formulas O and Q.

| Formula | A | O | P | Q |
|---|---|---|---|---|
| Na Sulfate: | — | — | — | 50.00 |
| $Ca\ CO_3$: | 85.00 | — | — | — |
| $Na\ HCO_3$: | — | 70.00 | 55.00 | 20.00 |
| $Na\ CO_3$: | 9.20 | 25.00 | 40.00 | 25.00 |
| Na LAS: | 1.45 | 1.30 | 1.30 | 1.30 |
| Na AS: | 0.91 | 0.86 | 0.86 | 0.86 |
| Na Acetate: | 1.50 | 1.52 | 1.52 | 1.52 |
| Na DCC: | 1.00 | 1.01 | 1.01 | 1.01 |

-continued

| Formula | A | O | P | Q |
|---|---|---|---|---|
| Perfume: | 0.20 | 0.20 | 0.18 | 0.18 |
| Greasy Soap Scum vs. A* | Basis | +0.2 | +0.0 | +0.8 |
| Greasy Dirt vs. A* | Basis | −2.5s | −2.5s | −2.2s |
| End Result Grit/Film Performance: | Basis | −1.0s | −1.1s | −0.7s |

*The performance data is presented relative to A. Positive numbers mean more material is left behind, therefore worse performance. Negative numbers mean less material is left behind, therefore better performance. Statistical significance from the A benchmark is indicated by 's'.

Based upon the above it is clear that replacement of the insoluble calcium carbonate by the specific soluble salt mixtures described herein provides superior overall performance.

What is claimed is:

1. A solid hard surface scouring cleanser composition comprising:

A. from about 0.5% to about 5% of bleach stable surfactant;

B. from about 10% to about 99% of abrasive/alkalinity material that is a mixture of water soluble carbonate salts, bicarbonate salts, and optional alkali metal sulfate salts, the ratio of carbonate salts to bicarbonate salts and optional alkali metal sulfate salts being from about 0.1:1 to about 10:1, the bicarbonate salts having a particle size in which from about 50% to about 100% have a diameter of from about 30 to about 100 microns and when bicarbonate and sulfate salts are present, the level of bicarbonate has to be at least about 5% by weight of the combined bicarbonate and sulfate salts;

C. from about 0.5% to about 4% by weight of a bleaching agent; and

D. from 0% to about 10% by weight of buffering agent and/or minor ingredients.

2. A composition in accordance with claim 1 wherein the bleach-stable surfactant is selected from the group consisting of: water-soluble paraffin sulfonate detergent surfactant; water soluble alkyl benzene sulfonate detergent surfactant; alkyl sulfate detergent surfactant and mixtures thereof.

3. A composition in accordance with claim 2 wherein the bleach-stable surfactant is a mixture of either a water-soluble paraffin sulfonate detergent surfactant or alkyl benzene sulfonate detergent surfactant with alkyl sulfate detergent surfactant salt, there being from about 8 to 18 carbon atoms in the said alkyl groups.

4. A composition in accordance with claim 2 wherein the bleaching agent is sodium dichloroisocyanurate.

5. A composition in accordance with claim 1 wherein the diameter of the bicarbonate particles is such that from about 80% to about 100% are within the range of from about 30 microns of 90 microns.

6. A composition in accordance with claim 1 wherein the bleaching agent is sodium dichloroisocyanurate.

7. A composition in accordance with claim 1 wherein the bleach stable surfactant is selected from the group consisting of sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, potassium coconut alkyl sulfate and mixtures thereof.

8. A composition in accordance with claim 7 containing alkyl benzene sulfonate having from about 10 to about 14 carbon atoms in the alkyl chain.

9. A composition in accordance with claim 1 containing additional buffering agent selected from the group consisting of sodium metasilicate, trisodium phosphate, tetrapotassium pyrophosphate, and mixtures thereof.

10. A composition in accordance with claim 1 wherein the bleaching agent is selected from the group consisting of potassium dichloroisocyanurate, sodium dichloroisocyanurate, 1,3-dichloro- 5,5-dimethylhydantoin, N-chlorosulfamide, and mixtures thereof.

11. A composition in accordance with claim 10 wherein the bleach stable surfactant is selected from the group consisting of sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, potassium coconut alkyl sulfate and mixtures thereof.

12. A composition in accordance with claim 11 containing alkyl benzene sulfonate having from about 10 to about 14 carbon atoms in the alkyl chain.

13. A composition in accordance with claim 11 containing additional buffering agent selected from the group consisting of sodium citrate; potassium citrate; sodium metasilicate; trisodium phosphate; tetrapotassium pyrophosphate; and mixtures thereof.

14. A composition in accordance with claim 1 wherein the bleach stable surfactant is water soluble alkyl sulfate having from about 8 to about 16 carbon atoms in the alkyl chain.

15. A solid hard surface scouring cleanser composition comprising:

A. from about 1.7% to about 3% of bleach stable surfactant;

B. from about 90% to about 99% of abrasive/alkalinity material that is a mixture of water soluble carbonate and bicarbonate salts, the ratio of carbonate to bicarbonate being from about 0.1:1 to about 0.80:1, the bicarbonate salt having a particle size in which from about 95% to about 100% has a diameter of from about 30 to about 90 microns;

C. from 0.5% to about 3% by weight of a bleaching agent; and

D. from 0% to about 5% by weight of buffering agent and/or minor ingredients.

16. The process of cleaning a hard surface comprising applying an effective amount of the composition of claim 15 to said hard surface with an effective amount of water and scrubbing said surface with a cleaning implement.

* * * * *